United States Patent [19]

Burton

[11] 4,186,672

[45] Feb. 5, 1980

[54] SEWING MACHINE MONITOR

[75] Inventor: Perry E. Burton, Fountain Inn, S.C.

[73] Assignee: Opelika Manufacturing Corp., Chicago, Ill.

[21] Appl. No.: 799,285

[22] Filed: May 23, 1977

[51] Int. Cl.[2] ..... D05B 69/36

[52] U.S. Cl. ..... 112/273; 250/233

[58] Field of Search ..... 112/273, 277, 271, 275, 112/272; 250/560, 233

[56] References Cited

U.S. PATENT DOCUMENTS 2,940,407 6/1960 Mitchell ..... 112/273

3,843,883 10/1974 De Vita et al. ..... 112/273 X 4,038,931 8/1977 Kosrow et al. ..... 112/277 X

FOREIGN PATENT DOCUMENTS 934843 10/1973 Canada ..... 112/273

*Primary Examiner*—Peter Nerbun

*Attorney, Agent, or Firm*—Jones, Thomas & Askew

[57] ABSTRACT

The rate of speed of thread being fed to a sewing machine needle is monitored so that when the thread speed decreases, indicating one or more malfunctions in the sewing operation, the operation of the sewing machine is automatically terminated.

7 Claims, 3 Drawing Figures

SEWING MACHINE MONITOR

BACKGROUND OF THE INVENTION

This invention relates to a control system for a sewing machine and the like, wherein thread being fed to the machine is monitored, and when the rate of thread feed decreases below a predetermined value, the operation of the machine is terminated.

In some continuous sewing operations, where the attendant does not physically operate the sewing machine but is required only to monitor the sewing machine operation along with the operation of other equipment, a sewing machine may accidentally continue to operate without properly sewing the work piece. For example, when the bottom looper thread gives out on a chain stitch sewing machine, or when the bobbin thread of a bobbin-type sewing machine gives out, it is difficult for an attendant to visually detect the depletion of the thread since the thread is on the bottom surface of the work product. If the bottom looper thread breaks or is depleted the thread being fed to the needle will form an incomplete top stitch in the work product. This means that the needle thread will continue to be fed to the sewing machine in spite of the fact that the bottom looper thread has broken or has been depleted and the attendant observing the machine operation is not likely to immediately detect the the depletion of the looper thread since the needle of the machine continues to insert the thread into the upper surface of the work product. In this situation the thread being fed through the sewing machine needle is not engaged by the bottom looper thread, and the needle thread tends to pull partially out of the hole formed by the sewing machine needle when the needle withdraws from the work product, and in most instances, the upper portion of the stitch made in the work product will remain in the work product. This results in a smaller amount of needle thread being used in the work product since portions of the thread are pulled out by the retraction of the needle from the work product, which results in the needle thread being fed at a slower rate to the sewing machine.

Other examples of a decrease in needle thread rate which indicate a sewing machine malfunction would be a decrease in stitch length as when the work piece is hung in the delivery mechanism or there is excessive drag on the work piece, a decrease in stitch depth as when the machine begins to sew through fewer plys of material, a break in the monitored thread as when the needle thread breaks, or when the machine skips stitches.

While various attempts have been made to control sewing machines and to terminate the operation of sewing machines in response to thread breakage or depletion of thread supply, the various known prior art devices monitor the tension of the thread being fed to a sewing machine or monitor the speed of operation of the sewing machine. These prior art devices apply more tension to the thread and occasionally vary the tension of the thread being fed to the sewing machine, resulting in a higher likelihood of thread breakage, or require more power to operate the sewing machine. Also, the known prior art devices generally cannot detect a malfunction in machine operation by monitoring the feed rate of a thread to a machine.

SUMMARY OF THE INVENTION

Briefly described, the present invention comprises a control system for sewing machines and the like which monitors the rate at which the thread is drawn to the machine and terminates the operation of the machine in response to a decrease in the rate of feed of the thread below a predetermined rate. The thread is extended about a rotatable element, and a photocell or other sensing means detects each rotation of the rotatable element. When the operation of the machine is initiated, the movement of the thread about the rotatable element causes the sensor to detect each rotation and to transmit a signal to a holding circuit. The holding circuit then continues the operation of the machine until the rate of thread movement to the machine drops below a predetermined rate, whereupon slower rotation of the rotatable element and the less frequent signals from the sensor to the holding circuit causes the holding circuit to open, whereupon the operation of the machine is terminated.

Thus, it is an object of this invention to provide a simple, inexpensive and reliable control system for sewing machines and the like which functions to terminate the operation of the machine upon a malfunction of the machine.

Another object of this invention is to provide a thread monitor for sewing machines and the like which detects the rate of speed of thread movement to the sewing machine and which terminates the operation of the sewing machine upon a decrease in the rate of thread movement to the sewing machine.

Other objects, features and advantages of this invention will become apparent upon reading the following specification, when taken in conjunction with the accompanying drawing.

DETAILED DESCRIPTION

Figure 1:
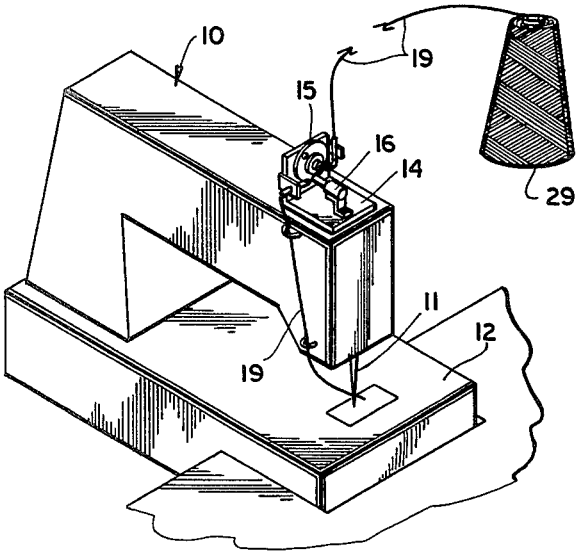
FIG. 1 is a perspective view of a sewing machine with the rotatable thread actuated element mounted on the sewing machine.

Referring now in more detail to the drawings, in which like numerals indicate like parts throughout the several views, FIG. 1 illustrates a sewing machine 10 which is of conventional construction in that it includes a motor 40 (FIG. 3), an electrically actuated clutch 38–39, and a reciprocatable needle 11. The sewing machine 10 can be a conventional sewing machine, such as a chain stitch machine or a bobbin machine, or can be other types of machines which processes thread to a work product. In the particular embodiment disclosed herein, the work product is arranged to be moved across the bed 12 of a chain stitch sewing machine beneath the needle 11. An example of the use of the sewing machine 10 is in a continuous sewing operation, such as in the continuous hemming of the edge of continuous material.

Figure 2:
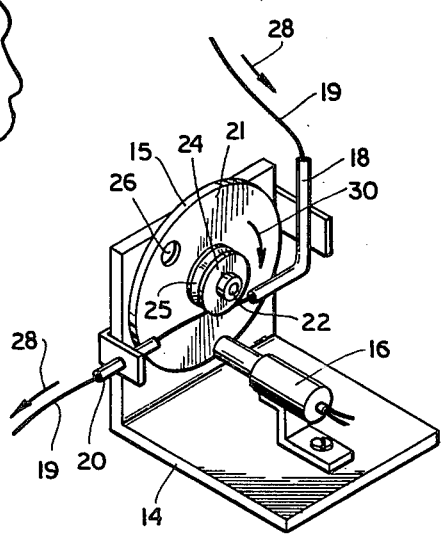
FIG. 2 is a perspective illustration of the rotatable element and the sensing means which monitors the thread movement about the rotatable element.

As illustrated in FIGS. 1 and 2, bracket 14 is mounted on the sewing machine, a rotatable element 15 is rotatably supported on the bracket 14, and a sensor 16 is also supported on the bracket adjacent the rotatable element 15. A thread infeed guide 18 guides the needle thread 19 toward the rotatable element 15, and a thread outfeed guide 20 guides the thread 19 away from the rotatable element 15. The rotatable element 15 comprises a large disc 21 rotatably mounted on axle 22, and smaller diameter sheave 24 mounted on the same axle 22 and rotatable in unison with the disc 21. The sheave includes an annular groove 25, and the thread passing through thread infeed guide 18 is wrapped about the sheave 24 in its groove 25. An aperture 26 is formed in disc 21. When the thread 19 moves in the direction indicated by arrows 28 from a supply 29 of the thread toward the needle 11 of the sewing machine 10, the thread will cause the rotatable element 15 to rotate in the direction as indicated by arrow 30.

Photoelectric cell 16 functions as a sensor and is mounted on bracket 14 so that it registers with the aperture 26 of the disc 21 when the aperture rotates in front of the cell. The photoelectric cell 16 can be the type that includes its own light source, and the disc 21 can be of a color that contrasts with the color of bracket 14, so that a change in light reflection is detected by the cell when the aperture 26 registers with the cell. On the other hand, a light source can be placed behind the rotatable element 15 so that light passes through the aperture 16 to the cell when the aperture registers with the cell.

Figure 3:
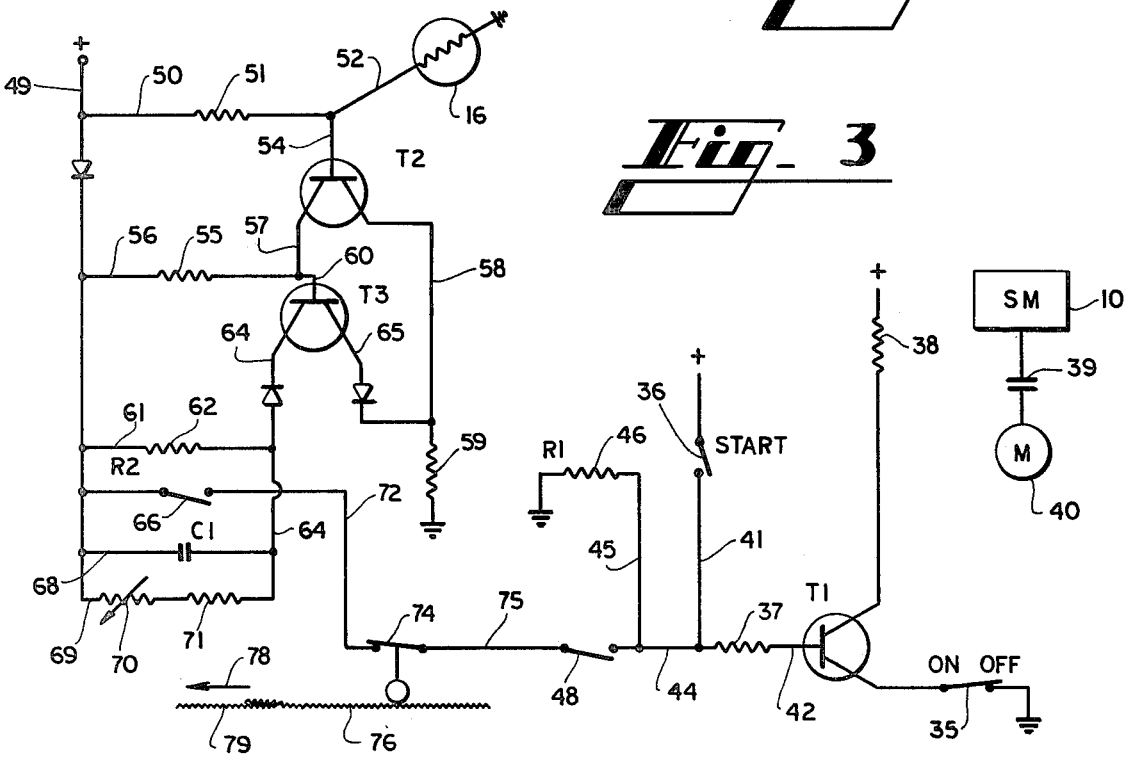
FIG. 3 is an electrical schematic of the control circuit for the sewing machine.

As illustrated in FIG. 3, the control circuitry for the thread monitor comprises a conventional on-off switch 35 that is connected between ground and transistor T1. A normally open start switch 36 extends from a source of positive current through conductor 41, resistor 37 to the base 42 of transistor T1. The solenoid resistor 38 of the clutch 39 of the sewing machine motor 40 and sewing machine 10 is connected between a source of positive current and the other terminal of transistor T1. When the on-off switch 35 is closed, and when the start switch 36 is closed, a circuit is made through conductor 41, resistor 37 to the base 42 of transistor T1, whereupon a circuit is made from the positive source of current through the clutch resistor 38, transistor T1, on-off switch 35, to ground. A circuit is also made from the source of current through start switch 36, conductor 41, conductor 44, conductor 45 through relay coil 46 of relay R1 to ground. This causes the switch 48 of relay R1 to close. In the meantime, the operation of the sewing machine 10 will have begun and the thread 19 moving into the sewing machine will cause the photoelectric cell 16 to conduct current from the source of positive current through conductors 49 and 50, resistance 51 and conductor 52. The base 54 of transistor T2 therefore causes the transistor T2 to change state, and a circuit is therefore made from conductor 49 through resistance 55, conductors 56 and 57, transistor T2, and conductor 58, through resistance 59, to ground. When a circuit is made through transistor T2, the base 60 of transistor T3 causes a change of state in the transistor T3 and closes a circuit through conductors 49, 61, relay coil 62 of relay R2, conductor 64, transistor T3, conductor 65, conductor 58, resistance 59 to ground. This causes the switch 66 of relay R2 to close. In addition, a circuit is made through conductors 49 and 68 to capacitor C1, conductor 64, through the transistor T3. Moreover, a circuit is made through conductors 49 and 69 through potentiometer 70, fixed resistance 71 and conductor 64 through transistor T3.

Since the signal emitted by photoelectric cell 16 is a pulsating signal, the relay R2 would normally pulse between open and closed conditions; however, the presence of capacitor C1 in parallel with the relay R2 allows the pulsing signal from the photoelectric cell 16 to alternately charge and discharge the capacitor C1. If the frequency of the signals emitted from cell 16 are high enough, the capacitor C1 will not have enough time to completely discharge between the signal pulses received from the cell 16, whereupon the switch 66 of relay R2 will remain closed. On the other hand, if the frequency of the signals transmitted from the cell 16 are low, the capacitor C1 will have enough time to completely discharge, whereupon relay R2 will drop out.

Relay R2 is connected through conductor 72, switch 74, and conductor 75 to the switch 48 of relay R1. Thus, once the manual start switch 36 has been momentarily closed and a circuit has been made to the relay R1 from the start switch, and once the operation of the sewing machine has been established and the thread movement initiated to the sewing machine needle, a holding circuit will be made from relay R2 through relay R1, so that when the operator releases the manual start switch 36, the sewing machine will continue to run as long as the rate of thread movement to the sewing machine is above a predetermined value.

When the rate of thread movement to the sewing machine decreases below a predetermined value, the capacitor C1 will have an opportunity to completely discharge and the relay R2 will open, therefore breaking the holding circuit made through relay R1. This causes the switch 48 of relay R1 to open, and the signal to transistor T1 is therefore lost and the clutch 39 between the sewing machine 10 and motor 40 will therefore open. This terminates the sewing machine operation.

The potentiometer 70 creates a variable bleed from capacitor C1 so that the time of holding of the relay R2 closed can be varied. This results in a change in operating conditions in the circuit, in that if the resistance through the potentiometer is reduced, the capacitor will discharge faster, requiring a higher frequency of signal emission from photocell 16 to keep the relay R2 closed. Thus, the thread feed rate to the sewing machine must be maintained at a relatively high rate in order to continue the operation of the sewing machine. Conversely, if the resistance of the potentiometer is increased, the capacitor C1 will discharge more slowly and the relay R2 has the ability to remain closed for longer periods between each pulse received from the cell 16, whereupon the feed rate of the thread to the sewing machine does not have to be maintained at such a high level and the sewing machine will continue to run.

Switch 74 is actuated by the work product 76 as the work product moves across the work table adjacent the sewing machine. The switch 74 is normally closed and is opened only when a protrusion, obstruction or some other variation in the height of the work product is detected. In the example illustrated in FIG. 3, the work product 76 moves in the direction as indicated by arrow 78, and the work product is shown as having a seam 79 therein, as if the end of one length of material had been sewn to the end of another length of material and a protrusion in the material was created. The overlap is likely to jam the sewing machine or attachments thereto, such as hem folders, so that it is desirable to terminate the operation of the sewing machine when an oncoming protrusion such as the overlap 79 is detected. The switch 74 will be momentarily opened by the passage therebeneath of the overlap 79, which momentarily opens the holding circuit to the relay R1. When the holding circuit to relay R1 is momentarily opened, the relay R1 immediately drops out and a subsequent closing of switch 74 will not reestablish the holding circuit. Thus, the sewing machine operation is terminated. In order to reestablish the operation of the sewing machine, the operator must close the start switch 36. When the sewing machine stops, the operator will be alerted to the presence of the overlap seam 79 in the work product and will make the necessary adjustments in the sewing machine to accommodate the overlap, or the operator will look for the breakage or depletion of the bottom looper thread.

While the invention has been disclosed in combination with a conventional seweing machine, it should be understood that various processes can be monitored with the invention, including carpet tufting and weaving, wherever a decrease in thread usage rate indicates an undesirable function in a machine or process. Moreover, while this invention has been described in detail with particular reference to a preferred embodiment thereof, it will be understood that variations and modifications can be effected within the spirit and scope of the invention as described hereinbefore and as defined in the appended claims.

I claim:

1. Apparatus for controlling the operation of a sewing machine and the like comprising signal input means for transmitting a pulsing signal at a frequency corresponding to the lineal velocity of a thread moving along its length to the machine with an increase of the lineal velocity of the thread causing a higher frequency of pulsing signals and a decrease of the lineal velocity of the thread causing a lower frequency of pulsing signals, start circuit means for actuating the operation of the machine, and holding circuit means for continuing the operation of the machine after the machine operation has been actuated, said holding circuit means including means responsive to each pulse of the pulsing signal from said signal input means to maintain said holding circuit closed during each pulse, and means for continuing the holding circuit closed for a predetermined period of time after each pulse, whereby the holding circuit is held closed as long as the time lapse between pulses is not more than the predetermined period of time.

2. The apparatus of claim 1 and wherein said signal input means comprises a rotatable member for engagement with and rotation by the thread moving to the machine, and means for detecting the rate of rotation of said rotatable member.

3. The apparatus of claim 1 and wherein said signal input means comprises a rotatable member for engagement with and rotation by the thread moving to the machine, said rotatable member including means for emitting a pulse of light upon each rotation of said rotatable member, and light detection means for receiving the pulses of light and for transmitting a signal upon the receipt of each pulse of light.

4. In combination, a sewing machine or the like, a motor, an electrically actuated clutch connected between said machine and said motor for driving said machine from said motor, a start circuit for actuating said clutch to cause said motor to drive said machine, a holding circuit for continuing the actuation of said clutch and the operation of said machine, signal input means responsive to the movement of thread toward said machine for transmitting a pulsing signal at a rate corresponding to the lineal velocity of the thread moving along its length toward said machine, said holding circuit including means responsive to each pulse from said signal input means to maintain said holding circuit closed during each pulse, and means for continuing the holding circuit closed for a predetermined period of time after each pulse, whereby as long as the thread moves at a high enough velocity along its length so that the time lapse between pulses is not more than the predetermined period of time the clutch is maintained in its driving relationship between the motor and the machine to continue the operation of the machine or if the thread moves at a slower velocity along its length so that the time lapse between pulses is longer than the predetermined time the clutch opens to terminate the operation of the machine.

5. The combination of claim 4 and wherein said signal input means includes a rotatable member for engagement and rotation by the movement of thread along its length toward said sewing machine, and sensing means for detecting each rotation of said rotatable member and for transmitting a signal upon the detection of each rotation of said rotatable member.

6. Apparatus for controlling the operation of a sewing machine and the like comprising signal input means for transmitting a pulsing signal at a frequency corresponding to the lineal velocity of a thread moving along its length to the machine, start circuit means for actuating the operation of the machine, and holding circuit means for continuing the operation of the machine after the machine operation has been actuated, said holding circuit means comprising a relay responsive to the pulsing signal from said signal input means to close upon receipt of the pulsing signal and to open in the absence of signal, a capacitor in parallel with said relay for being charged upon each pulsing signal from said signal input means and for discharging to said relay in the absence of a pulsing signal, whereby as long as the thread moves at a high enough velocity along its length so that the time between the pulses of the pulsing signal is not sufficient to permit the capacitor to completely discharge the relay remains closed to continue the operation of the machine or upon the thread moving at a slower velocity along its length so that the time between the pulses of the pulsing signal is longer than the time necessary for the capacitor to discharge the relay opens to stop the operation of the machine.

7. The apparatus of claim 6 and further including a potentiometer in parallel with said relay and said capacitor for varying the rate of charge and discharge of said capacitor.

* * * * *